US005799683A

United States Patent [19]

Hamada et al.

[11] Patent Number: 5,799,683

[45] Date of Patent: Sep. 1, 1998

[54] POPPET VALVE AND METHOD OF MANUFACTURING IT

[75] Inventors: Akihiro Hamada, Machida; Shinichi Umino, Yugawara-cho; Yuji Takano, Chigasaki, all of Japan

[73] Assignee: Fuji Oozx Inc., Kanagawa-Ken, Japan

[21] Appl. No.: 618,287

[22] Filed: Mar. 18, 1996

[51] Int. Cl.[6] ..... F01L 3/10

[52] U.S. Cl. ..... 137/15; 251/368; 123/188.3

[58] Field of Search ..... 251/368; 123/188.3; 137/15

[56] References Cited

U.S. PATENT DOCUMENTS

| | | | |
|---|---|---|---|
| 4,004,889 | 1/1977 | Gale et al. . | |
| 4,182,299 | 1/1980 | Earle et al. . | |
| 4,235,418 | 11/1980 | Natalizia | 251/368 |
| 4,729,421 | 3/1988 | Schatz | 251/368 |
| 4,737,201 | 4/1988 | Larson . | |
| 5,370,364 | 12/1994 | Kenmoku et al. | 251/368 |

FOREIGN PATENT DOCUMENTS

| | | |
|---|---|---|
| A-10 65 692 | 5/1957 | Germany . |
| A-61-009973 | 1/1986 | Japan . |
| A-01 259128 | 10/1989 | Japan . |

*Primary Examiner*—A. Michael Chambers
*Attorney, Agent, or Firm*—Zarley, McKee, Thomte, Voorhees, & Sease

[57] ABSTRACT

A poppet valve in an internal combustion engine comprises a valve head and a valve stem. On a valve face of the valve head, a hardened layer of dendrites in which crystals are directed from the inside to the surface is formed, thereby increasing wear resistance of the valve face without cladding.

6 Claims, 4 Drawing Sheets

POPPET VALVE AND METHOD OF MANUFACTURING IT

BACKGROUND OF THE INVENTION

The present invention relates to a poppet valve and a method of manufacturing it to increase wear resistance without cladding by welding of rigid material.

A valve face of the poppet valve used in an internal combustion engine is vigorously engaged on a valve seat repeatedly, and requires high wear resistance. To increase wear resistance, rigid alloy such as Co, Ni or Fe matrix is clad on the valve face.

FIG. 3 (A) to (C) illustrates how to clad by welding on the valve face in order. As shown in (A) of FIG. 3, prior to cladding, an arcuate annular groove 23 is formed on a valve face 22*a* of a valve head 22 of a poppet valve 21 made of heat resistant steel. Then, as shown in (B), Co rigid alloy 24 such as Stellite is clad on the annular groove 23 by welding means such as oxygen-acetylene gas, plasma arc and laser. Then, as shown in (C), the clad portion is mechanically processed to form the surface having a predetermined figure.

In the poppet valve where rigid alloy is clad, there are disadvantages as follows:

(a) Prior to cladding by welding, it is required to form the annular groove 23 in the head 22.

(b) Cladding material, especially Co rigid alloy, is expensive, and thin cladding consumes a large amount of the material, which is not economical.

(c) Cutting cost for finishing after cladding increases, so that a cutting tool becomes less durable and must be often replaced.

(d) It becomes expensive to manufacture poppet valves.

BRIEF DESCRIPTION OF THE DRAWINGS

The features and advantages of the present invention will become more apparent from the following description of embodiments with respect to drawings wherein.

SUMMARY OF THE INVENTION

To solve the above-mentioned disadvantages, it is an object of the present invention to provide a poppet valve in which wear resistance on a valve face increases without cladding to make rigid alloy unnecessary to reduce cost for manufacturing.

According to one aspect of the present invention, there is provided a poppet valve which comprises a valve head and a valve stem, the valve head having a valve face which has a hardened layer of dendrites in which crystals are directed from the inside to the surface of the valve face.

Without conventional cladding by welding, wear resistance of the valve face is increased, thereby making expensive rigid alloy except valve material unnecessary and minimizing treatment before and after cladding, so that low cost poppet valve is obtained.

Nitrides and/or carbides may be distributed in the dendrites.

According to another aspect of the present invention, there is provided a method of manufacturing a poppet valve which comprises a valve head and a valve stem, the valve head having a valve face, the method comprising the steps of welding the valve face by heat at a predetermined temperature; and cooling the valve head forcibly from a top flat surface of the valve head immediately after the welding step. Thus, in the dendrites, nitrides and/or carbides can be easily distributed.

The valve face may be locally heated and welded by high density energy laser and plasma arc generated in an inactive gas atmosphere Thermal energy is concentrated, thereby minimizing thermal strain on the other parts and preventing oxidation of the heated portion.

DETAILED DESCRIPTION OF PREFERRED EMBODIMENT

Figure 1:
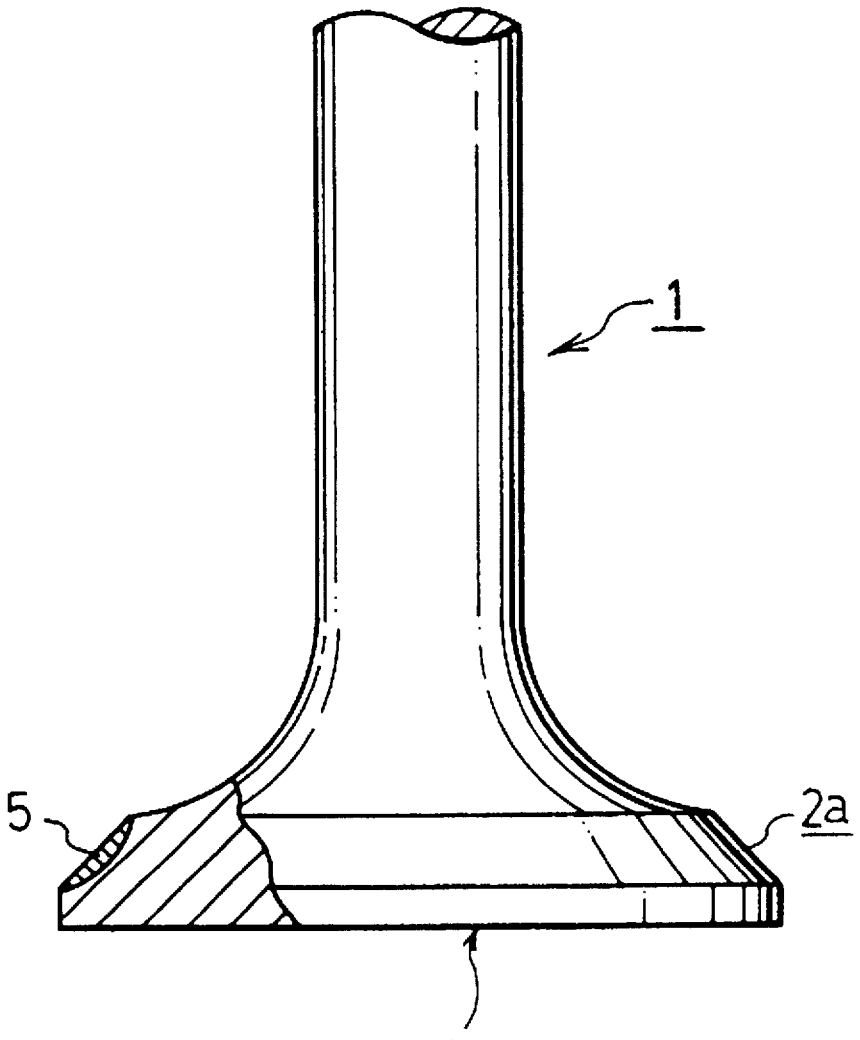
FIG. 1 is a partially broken front elevational view which illustrates an embodiment of a poppet valve according to the present invention.

FIG. 1 illustrates a main part of a poppet valve 1 which is made of heat-resistant steel such as SUH3, SUS11 and SUH36 or Inconel (NCF751). On a valve face 2*a* of a valve head 2, there is formed a hardened layer 5 of dendrites in which crystals are directed from the inside to the surface of the valve face 2*a*. Carbides and nitrides are distributed in the dendrites of the hardened layer 5.

Figure 2:
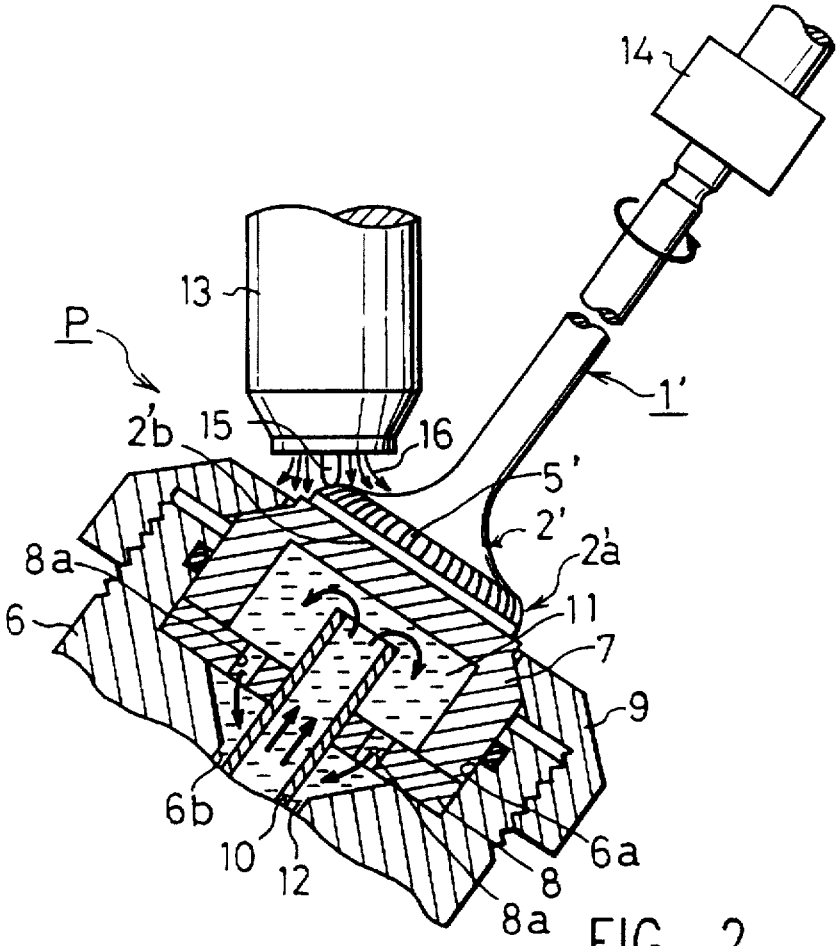
FIG. 2 is a central vertical sectioned front elevational view which illustrates how to manufacture the poppet valve in FIG. 1 using a powdery material cladding device.
Figure 3A:
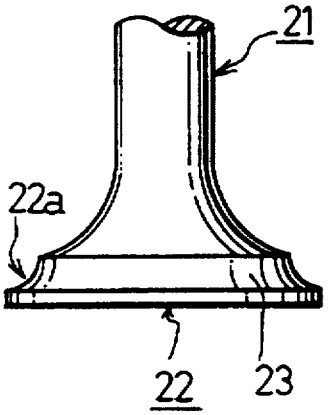
FIGS. 3A, 3B and 3C are views which illustrate a conventional process for cladding by welding.
Figure 3B:
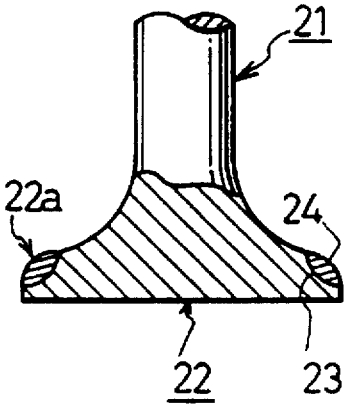
Figure 3C:
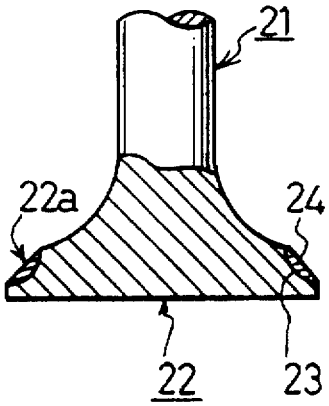

FIG. 2 illustrates how to manufacture the poppet valve 1 or how to form the hardened layer 5, which is made using a known plasma-arc type powdery material cladding device "P". In the device, the numeral 6 denotes a rotary drive support in which its axis is inclined by about 35 degrees, and is slowly rotated in a predetermined direction by a reduction motor (not shown). In a recess 6 formed on the upper surface of the rotary drive support 6, a cylindrical workpiece receiver 7 in which the upper surface is closed is fitted via a spacer 8. The workpiece receiver 7 is prevented from disengagement by a binding ring 9 which is fitted around the outer circumferential surface of the upper end of the rotary drive support 6. The numeral 10 denotes a water supply tube which is put in a bore 6*b* in the center of the rotary drive support 6. The upper end of the water supply tube 10 is disposed in the recess 11 of the workpiece receiver 7 through the spacer 8. Cooling water supplied in the water supply tube 10 is filled in the recess 11, and, then, is discharged to the outside via a plurality of water bores 8*a* and a discharge path 12 around the water supply tube 10.

The numeral 13 denotes a plasma-arc generating torch which has a vertical axis, and is movable in vertical and horizontal directions above the workpiece receiver 7. The numeral 14 denotes a rotatable workpiece holder on the axis of the workpiece receiver 7. To form the hardened layer, a workpiece 1' in which a valve head 2' having a valve face 2'*a* is formed almost like a poppet valve 1 to be made is placed on the top flat surface 2'*b* of the head 2', and the axial end of the workpiece 1' is pressed by the workpiece holder 14. Then, by operation of the rotary drive support 6, the workpiece 1' is rotated in a predetermined direction. At the same time, a plasma arc 15 is generated from a torch 13 above the valve face 2'*a*, so that the surface of the valve face 2'*a* is locally heated above a melting point of the valve material, such as 1500° C. An inactive shield gas 16 such as Ar is jetted from the circumference of the plasma arc 15 at the lower end of the torch 13 to prevent oxidation of a heated portion. At the same time with heat welding of the valve face 2'a, $N_2$ and/or $CO_2$ is supplied towards the heated portion through a plurality of supply bores (not shown) for cladding powdery material, the bores opening at the upper end of the torch 13 around the plasma arc 15 and directing towards the center of the plasma arc. Thus, nitrogen and/or carbon is entered on the upper surface of the heated valve face 2'a, thereby achieving similar function to nitriding or carburizing, so that rigid nitride and/or carbide is formed.

Figure 4:
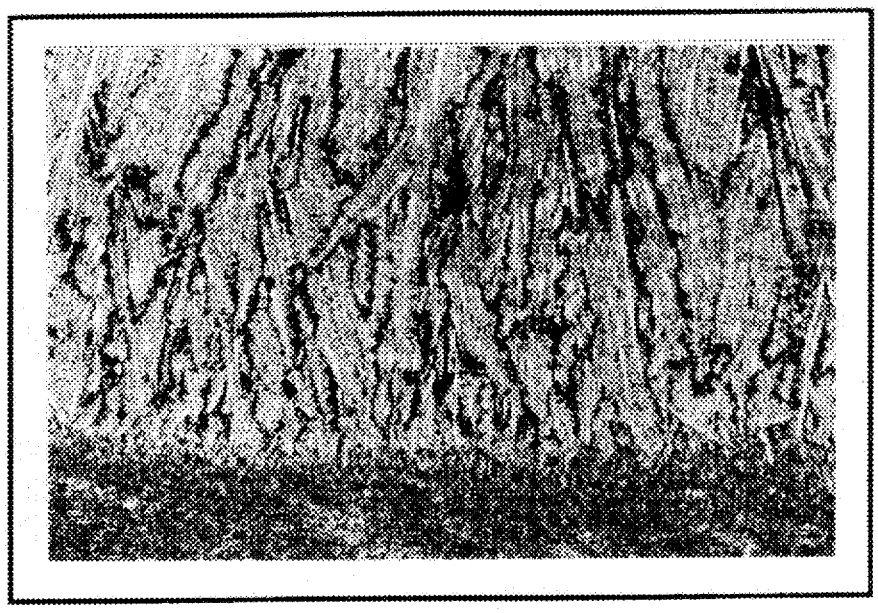
FIG. 4 is a photomicrograph in which a vertical section of a valve face is magnified by one hundred times.
Figure 5:
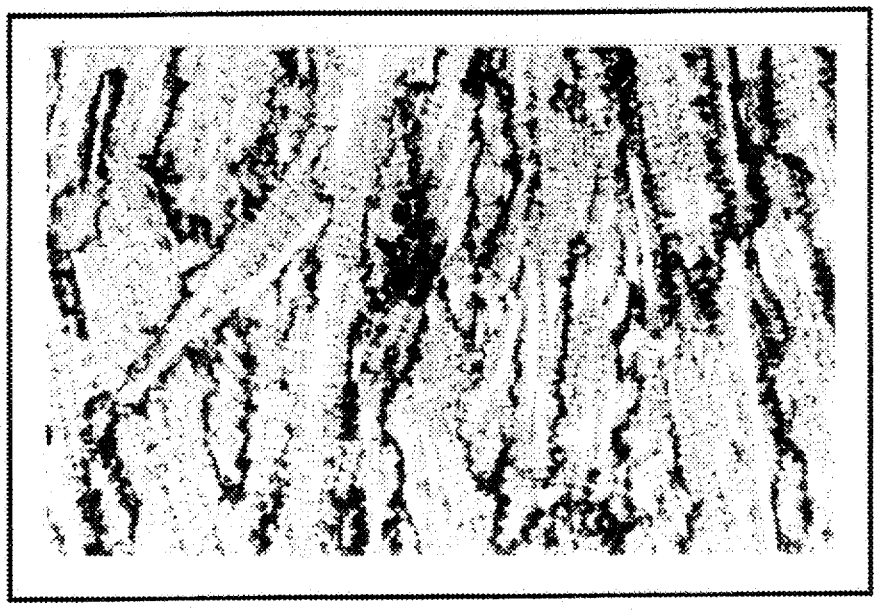
FIG. 5 is a photomicrograph magnified by two hundred times thereof.
Figure 6:
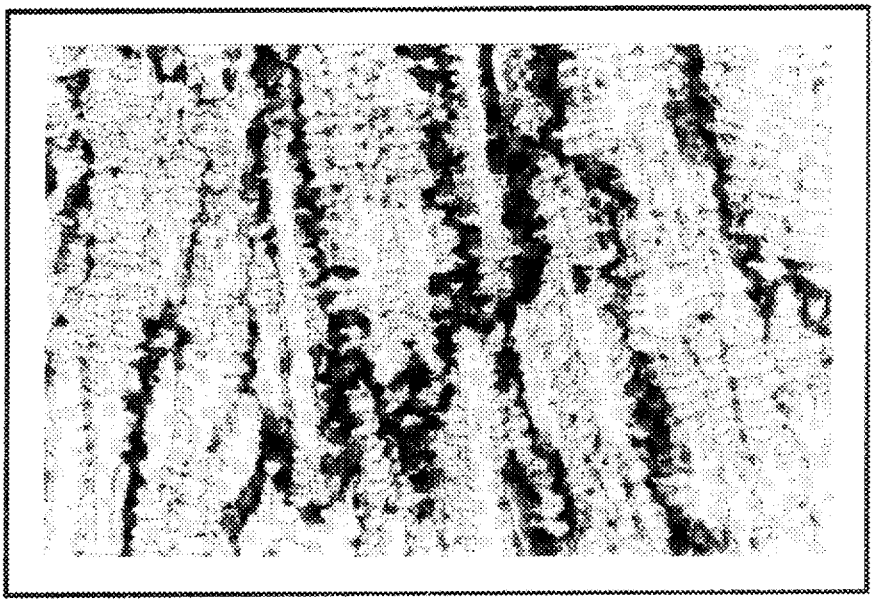
FIG. 6 is a photomicrograph magnified by four hundred times thereof.

In the meantime, the valve face 2'a which is locally heated is forcibly cooled in order from the top flat surface 2'b of the valve head by the workpiece receiver 7 which has lower temperature by cooling water, thereby forming dendrites in which crystals are directed towards the surface of the valve face. FIG. 4 to 6 are microphotographs in which the vertically sectioned structure of the valve face 2'a is magnified by one-, two- and four-hundred times respectively. As shown in the microphotographs, the crystals are directed from the inside of the material (lower part of the microphotographs) to the surface of the valve face (upper part of the microphotographs) like dendrites. In the microphotographs, distributed black portions comprise nitrides and carbides.

The dendrites has high hardness, and nitrides or carbides are distributed in the dendrites, so that the hardened layer 5' is formed on the surface of the valve face 2'a after heating of whole circumference by one rotation of the workpiece 1'. The hardened layer 5' is finished to form a flat surface, thereby obtaining the poppet valve 1 similar to that in FIG. 1.

After manufacturing as above, hardness of the surface of the valve face 2a is determined. Hardness of a valve face of a normal poppet valve which has not been treated by the present invention is HRC35, while hardness of the poppet valve 1 in the foregoing embodiment is proved to increase to HRC40 to 50, which is almost equal to one in which Stellite, normal cladding material, is clad, thereby achieving excellent wear resistance.

The present invention is not limited to the foregoing embodiment, but as means for heating and welding the valve face 2'a, oxygen-acetylene gas or laser heating source may be used instead of the above plasma-arc type powdery material welding means "P".

The foregoings merely relate to embodiments of the present invention. Various modifications and changes may be made by persons skilled in the art without departing from the scope of claims wherein:

What is claimed is:

1. A method of manufacturing a poppet valve which comprises a valve head and a valve stem, the valve head having a valve face, the method comprising the steps of:

locally welding the valve face by heat at a predetermined temperature by high density energy source in inactive gas atmosphere, while a gas selected from the group consisting of $N_2$ and $CO_2$ is supplied to a heated portion of the valve face of the valve which is rotated in a predetermined direction; and cooling the valve head by forcibly passing a cooling fluid proximate to a top flat surface of the valve head immediately after the welding step.

2. A method as defined in claim 1 wherein the valve is made of heat resistant steel.

3. A method as defined in claim 1 wherein the valve is made of Inconel.

4. A poppet valve comprising:

a valve stem, a valve head attached to the valve stem, the valve head having a valve face which has a hardened layer of dendrites in which crystals are directed from an inside of the valve head to an outer surface of the valve face, microscopic particles selected from the group consisting of nitrides and carbides being distributed in said dendrites.

5. A poppet valve as defined in claim 4 wherein the valve is made of heat resistant steel.

6. A poppet valve as defined in claim 4 wherein the valve is made of Inconel.

* * * * *